US009028058B2

(12) United States Patent
Seto

(10) Patent No.: US 9,028,058 B2
(45) Date of Patent: May 12, 2015

(54) PAPER BASIS WEIGHT SENSING DEVICE AND METHOD, AND IMAGE FORMING APPARATUS INCORPORATING SAME

(71) Applicant: Masami Seto, Osaka (JP)

(72) Inventor: Masami Seto, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/177,310

(22) Filed: Feb. 11, 2014

(65) Prior Publication Data

US 2014/0232780 A1 Aug. 21, 2014

(30) Foreign Application Priority Data

Feb. 21, 2013 (JP) ..... 2013-032248
Dec. 17, 2013 (JP) ..... 2013-260421

(51) Int. Cl.
*B41J 11/00* (2006.01)

(52) U.S. Cl.
CPC ..... *B41J 11/009* (2013.01)

(58) Field of Classification Search
USPC ..... 347/19, 102
See application file for complete search history.

(56) References Cited

U.S. PATENT DOCUMENTS 3,757,122 A * 9/1973 Bossen et al. ..... 250/358.1
2003/0141529 A1 7/2003 Seto et al.
2004/0183155 A1 9/2004 Seto et al.
2005/0146004 A1 7/2005 Seto
2006/0060939 A1 3/2006 Seto et al.
2006/0144144 A1 7/2006 Seto
2007/0022814 A1 2/2007 Seto
2007/0037310 A1 2/2007 Seto
2008/0094459 A1* 4/2008 Sakagami ..... 347/102
2009/0263149 A1* 10/2009 Makino ..... 399/44
2011/0064502 A1 3/2011 Hase et al.
2014/0079458 A1* 3/2014 Seto et al. ..... 399/389

FOREIGN PATENT DOCUMENTS

JP 7-055748 3/1995
JP 9-179435 7/1997
JP 2002-068504 3/2002
JP 2004-144999 5/2004
JP 2006-058493 3/2006
JP 2009-046218 3/2009
JP 2010-197535 9/2010
JP 2011-064772 3/2011

* cited by examiner

*Primary Examiner* — Shelby Fidler
(74) *Attorney, Agent, or Firm* — Cooper & Dunham LLP

(57) ABSTRACT

A sheet basis weight sensing device for an image forming apparatus includes a sensor to detect heat conductivity of an ambient gas on a surface of a sheet on which the droplet is deposited or the surface opposite the sheet before and after the droplet is deposited; and a controller configured to: measure a time it takes the heat conductivity after the droplet is deposited to change by a predetermined ratio compared to the heat conductivity before deposition of the droplet; and obtain the sheet basis weight based on a relation between the time and the basis weight. The sheet basis weight sensing device further includes a memory to store a first table and a second table, and an image forming condition controller to set an appropriate image forming condition with reference to the second table.

4 Claims, 5 Drawing Sheets

T1

| TIME CHANGE t2 | BASIS WEIGHT |
|---|---|
| t2A | TA |
| ⋮ | ⋮ |
| t2B | TB |
| ⋮ | ⋮ |
| t2C | TC |
| ⋮ | ⋮ |

T1

| TIME CHANGE t2 | BASIS WEIGHT |
|---|---|
| t2A | TA |
| ⋮ | ⋮ |
| t2B | TB |
| ⋮ | ⋮ |
| t2C | TC |
| ⋮ | ⋮ |

PAPER BASIS WEIGHT SENSING DEVICE AND METHOD, AND IMAGE FORMING APPARATUS INCORPORATING SAME

CROSS-REFERENCE TO RELATED APPLICATIONS

The present application claims priority pursuant to 35 U.S.C. §119 from Japanese patent application numbers 2013-032248 and 2013-260421, filed on Feb. 21, 2013 and Dec. 17, 2013, the entire disclosures of which are incorporated by reference herein.

BACKGROUND

1. Technical Field

The present invention relates to a sheet basis weight sensing device and method for sheets of paper, and to an image forming apparatus including the sheet basis weight sensing device.

2. Related Art

Conventionally, various items have been used for evaluating printing characteristics of a sheet of paper or recording medium (to be referred to as a sheet, hereinafter) on which an image is formed, such as thickness, density, basis weight, smoothness, and air permeability. Many items representing properties and qualities of the sheet are listed in Paper, Board and Pulp—Vocabulary of the Japanese Industrial Standard (JIS P0001), including the basis weight, which represents the weight of the paper per square meter [g/m$^2$]. The basis weight is represented by the density of the sheet multiplied by the thickness (that is, basis weight=density*thickness).

Image forming apparatuses can be configured to incorporate a sensing device capable of identifying the thickness and type of various sheets reliably and accurately during conveyance of the recording medium through the apparatus during image formation. However, since identifying only the thickness or the type of the sheet alone does not provide the sheet density, the basis weight cannot be accurately identified.

SUMMARY

Accordingly, the present invention provides a sheet basis weight sensing device for use in an image forming apparatus and includes a sheet on which a droplet is deposited; a sensor to detect heat conductivity of an ambient gas on a surface of the sheet on which the droplet is deposited or the surface opposite the surface of the sheet on which the droplet is deposited before and after the droplet is deposited; and a controller configured to: measure a time it takes the heat conductivity after the droplet is deposited to change by a predetermined ratio compared to the heat conductivity before deposition of the droplet; and obtain the sheet basis weight based on a relation between the time and the basis weight.

The sheet basis weight sensing device further includes a memory to store a first table describing a relation between the time and the basis weight and a second table describing a relation between the identified basis weight and an image forming condition related to the sheet, and an image forming condition controller to set an appropriate image forming condition with reference to the second table.

These and other objects, features, and advantages of the present invention will become apparent upon consideration of the following description of the preferred embodiments of the present invention when taken in conjunction with the accompanying drawings.

DETAILED DESCRIPTION

Figure 1:
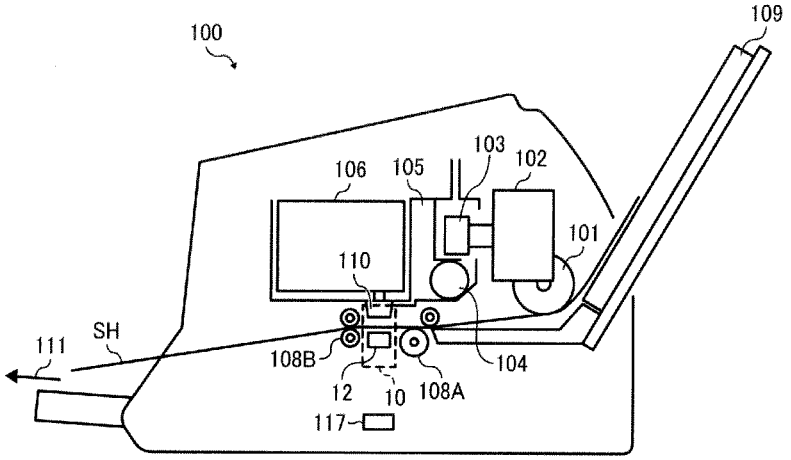
FIG. 1 is a schematic view of an image forming apparatus according to an embodiment of the present invention.

FIG. 1 illustrates a schematic view of an image forming apparatus 100 according to an embodiment of the present invention. The image forming apparatus 100 as illustrated in FIG. 1 shows an image forming apparatus employing an inkjet printing system. As illustrated in FIG. 1, the image forming apparatus 100 includes a sheet pressing roller 101, a drive motor 102, a drive belt 103, a main shaft 104, a carriage 105, an ink cartridge 106, sheet feeders 108A, 108B, a basis weight sensing device 10, and an apparatus controller 117.

The sheet pressing roller 101 presses a sheet SH supplied from a paper tray 109 with a predetermined pressure in a sheet discharge direction 111 as indicated by an arrow and through the sheet feeders 108A, 108B. The drive motor 102 drives the drive belt 103 connecting thereto, and moves the carriage 105 in a direction perpendicular to the surface of the sheet SH via the main shaft 104. The main shaft 104 is disposed perpendicularly relative to the discharge direction 111 of the sheet SH. The ink cartridge 106 is mounted on the carriage 105. The ink cartridge 106 includes four colors of ink, typically cyan, magenta, yellow, and black. The sheet feeders 108A and 108B are rollers that sandwich the sheet SH in between. When the rollers 108A and 108B rotate, the sheet SH is discharged in the sheet discharge direction 111 as indicated by the arrow.

As illustrated in FIG. 1, the basis weight sensing device 10 includes a print head 110 and a sensor 12. The print head 110 moves via the main shaft 104 and discharges droplets of ink in the ink cartridge 106 onto the sheet SH, and thus, a predetermined image is formed on the sheet SH. The sensor 12 detects the heat conductivity [W/mK] of an ambient gas (or air) in the vicinity of the rear side of the sheet SH at two points in time, before and after the liquid droplet is deposited on the sheet SH. The apparatus controller 117 controls an overall operation of the image forming apparatus 100.

Figure 2:
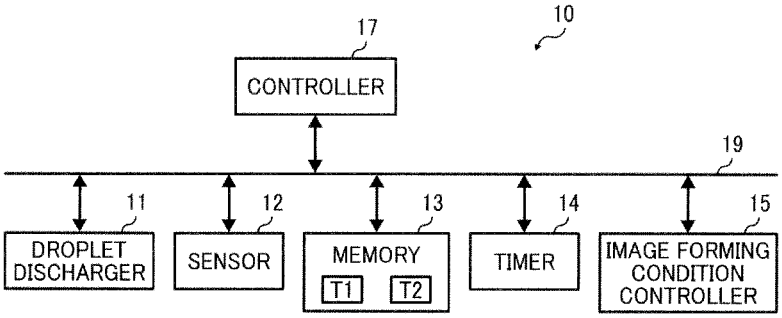
FIG. 2 is a block diagram illustrating a structure of a sheet basis weight sensing device 10 of FIG. 1.

FIG. 2 is a block diagram illustrating the structure of the basis weight sensing device 10 of FIG. 1. As illustrated in FIG. 2, the basis weight sensing device 10 is constructed of the droplet discharger 11, the sensor 12, a memory 13, 14, an image forming condition controller 15, and a sensor controller 17 all electrically connected to each other via a control line 19.

Figure 3:
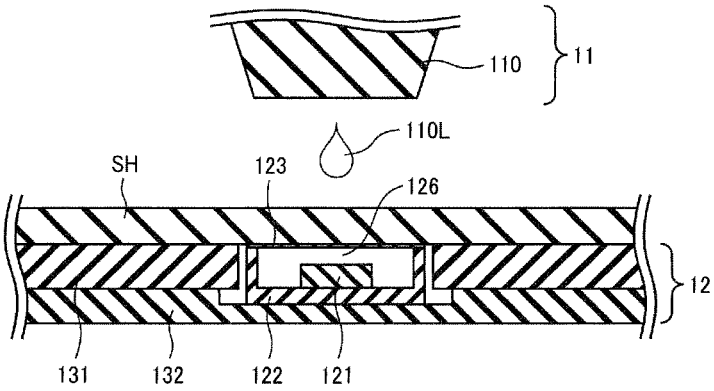
FIG. 3 is an enlarged cross-sectional view illustrating a detailed structure of a droplet discharger 11 and a sensor 12.

The droplet discharger 11 discharges liquid droplets onto the sheet SH and forms a predetermined image thereon. The droplet discharger 11 is implemented by the print head 110 to discharge ink droplet onto the sheet SH using the ink supplied from the ink cartridge 106 illustrated in FIG. 1. The sensor 12 detects the heat conductivity [W/mK] of the ambient gas in the space of the side opposite the surface of the sheet SH on which the liquid droplet is deposited. The sensor 12 includes a heat conductivity sensor 121 as illustrated in FIG. 3. The memory (storage) 13 stores data in tables T1 and T2. Table T1 describes a relation between a time t2 (which will be described later) and the basis weight of the sheet SH. Table T2 describes a relation between image forming conditions, such as a sheet discharge speed or a fixing temperature, relative to the detected basis weight and the sheet SH. A detailed description of Tables T1 and T2, and the relations they describe, is deferred.

The timer 14 measures e of each operation and reports the measured time to the sensor controller 17. The image forming condition controller 15 sets a predetermined image forming condition based on the relation between the basis weight and the image forming condition according to controlling by the sensor controller 17. The sensor controller 17 controls the operation of the sheet basis weight sensing device 10, and performs a sheet basis weight detection process and an image forming condition setting process, so as to detect the basis weight of the sheet SH and set the image forming condition. The controller 17 is in turn controlled by the controller 117 of the image forming apparatus 100 as illustrated in FIG. 1.

FIG. 3 illustrates the droplet discharger 11 and the sensor 12 in detail. As illustrated in FIG. 3, the droplet discharger 11 includes the print head 110. The sensor 12 is constructed of bases 131 and 132, the heat conductivity sensor 121 disposed in a cavity 126 formed jointly by the bases 131 and 132, a sensor package 122, and a permeable film 123.

The heat conductivity sensor 121 may be formed of a heat conductivity detection sensor with a micro-heater structure to measure the heat conductivity of the gas like that disclosed in JP-2889909-B (JP-H07-55748-A). Such a heat conductivity detection sensor with a micro-heater structure exhibits optimal responsiveness and high reliability. The thus-constructed heat conductivity sensor 121 can accurately measure the heat conductivity of the gas in the cavity 126 before and after the droplet 110L discharged from the print head 110 is deposited on the sheet SH. Further, it is preferred that the heat conductivity sensor 121 be disposed in the vicinity of the sheet SH as much as possible in order to accurately measure the heat conductivity of the gas in the cavity 126.

The sensor package 122 is disposed to cover bottom and lateral surfaces of the heat conductivity sensor 121. The permeable film 123 is disposed above the sensor package 122. The upper surfaces of the permeable film 123 and the base 131 are constructed on the same plane with no level difference on each surface. This is advantageous in preventing output from the heat conductivity sensor 121 from decreasing and the responsiveness thereof from deteriorating due to accumulated foreign particles such as paper dust accumulating in the repeated conveyance of the sheet SH.

Figure 4:
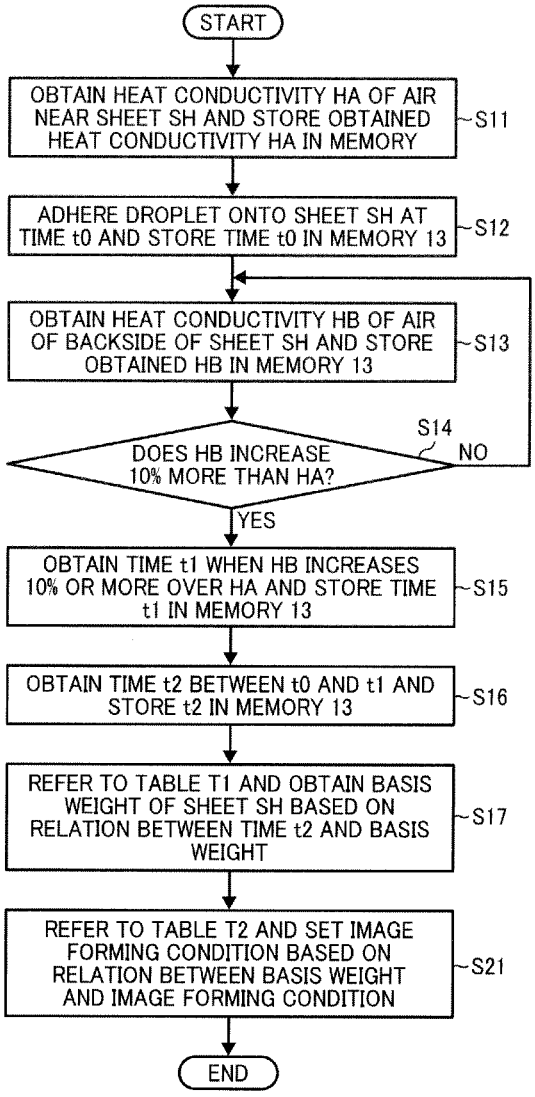
FIG. 4 is a flowchart illustrating a sheet basis weight detection process and an image forming condition setting process.

FIG. 4 is a flowchart illustrating the sheet basis weight detection process performed by the basis weight sensing device 10 as illustrated in FIG. 1 and the image forming condition setting process.

First, steps S11 to S17 relating to the sheet basis weight detection process will be described.

In Step S11, the sensor controller 17 controls the sensor 2 to detect a heat conductivity HA of the ambient gas either at the surface of the sheet SH on which the liquid droplet is to be deposited before the droplet is actually deposited or on the opposite side of the sheet from the side on which the droplet is to be deposited, and the sensor controller 17 stores the detected heat conductivity HA in the memory 13. In Step S12, the sensor controller 17 causes the discharger 11 to discharge a liquid droplet on the surface of the sheet SH, causes the timer 14 to start a count time t0 when the liquid droplet is deposited on the sheet SH, and stores the counted time t0 in the memory 13. In Step S13, the sensor controller 17 causes the sensor 12 to detect a second heat conductivity HB of the ambient gas at a rear side of and near the surface of the sheet SH after the liquid droplet is actually deposited thereon and stores the heat conductivity HB in the memory 13. By measuring moisture of the ambient gas on the opposite surface of the sheet SH on which the droplet is deposited, difference in the speed of the droplet penetrating into the sheet SH can be measured.

Next, in Step S14, the sensor controller 17 determines whether the heat conductivity HB after the droplet has been deposited on the sheet SH increased more than 10% compared to the heat conductivity HA before the deposition of droplet. In other words, in Step S14, the sensor controller 17 determines whether the heat conductivity HB after the droplet deposition increased to 1.1 times of HA compared to the heat conductivity HA before the droplet deposition. When the determination in Step S14 is not satisfied (NO in S14), the sensor controller 17 returns to Step S13 and repeats the same operation.

If the determination in Step S14 is satisfied (Yes in S14) in the following step S15, the sensor controller 17 causes the timer 14 to count a time t1 when the heat conductivity HB after the droplet deposition increased more than 10% compared to the heat conductivity HA before the droplet deposition. The sensor controller 17 stores the counted time t1 in the memory 13. In Step S16, the sensor controller 17 calculates a time t2 ($t2=t1-t0$) between the time t0 and the time t1 and stores the calculated time t2 in the memory 13.

Figures 5, 6:
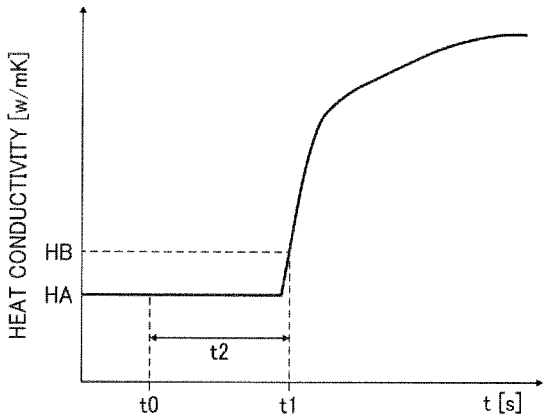
FIG. 5 is a graph for use in the sheet basis weight detection process of FIG. 4 to show a relation between heat conductivity and time.
FIG. 6 shows details of Table T1 stored in a memory 13 of FIG. 2.

FIG. 5 shows a relation between the heat conductivity HA at the time t0 when the droplet deposits on the sheet SH, the time t1 when the heat conductivity HB first increases more than 10% compared to the heat conductivity HA, and the time t2 between the time t0 and the time t1. As illustrated in FIG. 5, when the liquid droplet is deposited on the sheet SH at the time t0, moisture and solvent component included in the deposited droplet start to penetrate into the sheet SH. Then, at the time t1 elapsed from time t2 from the time t0, the heat conductivity HB of the ambient gas on the side opposite the droplet deposited surface of the sheet SH shows the value corresponding to 1.1 times the HA value compared to the heat conductivity HA. Thus, the solvent component of the deposited droplet penetrating from the deposited surface of the sheet SH reaches the rear side of the sheet SH and is diffused to the gas of the rear side of the sheet SH, so that the heat conductivity detected by the sensor 12 increases.

Returning to FIG. 4, in Step S17, the sensor controller 17 refers to Table T1, and obtains the basis weight of the sheet SH based on a relation between the time t2 and the basis weight. FIG. 6 shows details of Table T1 stored in the memory 13 of FIG. 2. As shown in FIG. 6, Table T1 includes the times t2A to t2C and the basis weights TA to TC corresponding to each times t2A to t2C.

Figure 7:
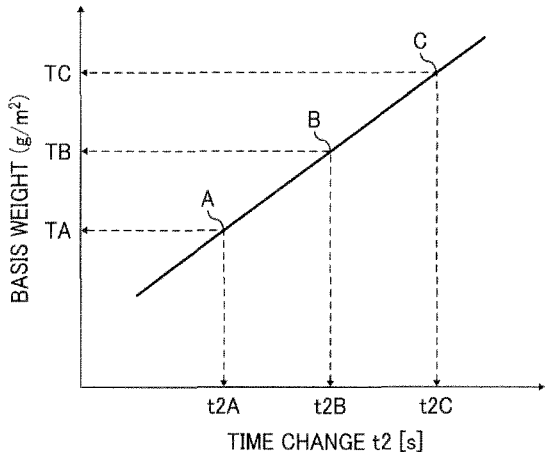
FIG. 7 is a graph to show a relation between times t2A to t2C in Table T1 of FIG. 6 and basis weights TA to TC corresponding to each time t2A to t2C.

Further, FIG. 7 is a graph showing a relation between times t2A to t2C in Table T1 of FIG. 6 and basis weights TA to TC corresponding to each time t2A to t2C. As illustrated in FIG. 7, as the times t2A to t2C increase, the corresponding basis weights TA to TC increase respectively. In the relation as illustrated in FIG. 7, when the sheet SH is thick or the density of the sheet SH is high, the time t2 in which the moisture of the deposited droplet or solvent components of the ink penetrates to a rear side of the sheet SH to become a predetermined heat conductivity HB or more, increases and the corresponding basis weight also increases. As a result, the sensor controller 17 while referring to Table T1 as illustrated in FIG. 6, based on the relation between the time t2 and the basis weight as illustrated in FIG. 7, detects the basis weight corresponding to the time t2 automatically and accurately. The above steps S11 to S17 relate to the sheet basis weight detection process according to the present embodiment.

Next, returning to FIG. 4, in Step S21, the image forming condition controller 15 sets a predetermined image forming condition for the image forming apparatus 100 based on the relation between the basis weight and the image forming condition, such as the sheet discharge speed or the fixing temperature, with reference to Table T2.

As described above, the sheet basis weight sensing device 10 is constructed of the droplet discharger 11 to discharge the droplet onto the sheet SH, and the sensor 12 to detect the heat conductivity of the ambient gas in the vicinity of the sheet SH of the surface opposite the droplet deposited surface before and after the deposition of the droplet 110L discharged from the droplet discharger 11. The sheet basis weight sensing device 10 further includes the sensor controller 17 to calculate the time t2 in which the heat conductivity HB after the droplet deposition increases more than the predetermined ratio compared to the heat conductivity HA before the droplet deposition, and detect the basis weight of the sheet SH based on the relation between the time t2 and the basis weight. The sensor controller 17 while referring to Table T1 as illustrated in FIG. 6, based on the relation between the time t2 and the basis weight as illustrated in FIG. 7, detects the basis weight corresponding to the time t2 properly. As a result, the correct basis weight of the sheet SH can be identified.

Further, the sheet basis weight sensing device 10 includes the image forming condition controller 15 to set the image forming condition based on the detected basis weight of the sheet SH. Specifically, the image forming condition controller 15 sets the image forming condition (S21) referring to Table T2 and based on the relation between the basis weight and the image forming condition. Accordingly, image quality of the image formed by the image forming apparatus 100 can be improved.

The image forming apparatus 100 is not limited to the inkjet printing system, but is similarly adaptable to other types of image forming apparatuses such as copiers, printers, facsimile machines, or a multifunction device including each function of the above-described apparatuses.

Further, the heat conductivity sensor 121 is not limited to the one disclosed herein. Alternatively, another type of ambient sensor such as a moisture sensor disclosed in Japanese Patent No. JP-2889909-B (JP-H07-55748-A) can be employed.

Furthermore, in the above-described embodiment, an ink droplet is employed, but droplets of any liquid other than the ink can be used.

A modified example will be now explained.

Figure 8:
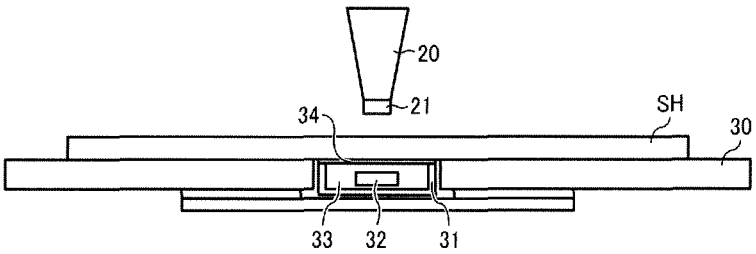
FIG. 8 is a side view illustrating a structure of a sheet basis weight sensing device according to a modified example.

In the above embodiment, liquid droplets are impacted on the sheet SH. FIG. 8 illustrates a method of employing a moisture-absorbing part 21 which is configured to contact the sheet SH. As illustrated in FIG. 8, a sensor package 31 is mounted on a support base 30. The sensor package 31 includes a cavity 33, a sensor 32 disposed in the cavity 33 and configured to detect the heat conductivity, and a permeable film 34 disposed above the sensor 32. Then, the sheet SH is placed on the support base 30 having the sensor package 31. Just above the sensor 32, a hoistable moisture adherer 20 including a moisture-absorbing part 21 is disposed. The moisture-absorbing part 21 of the moisture adherer 20 is lowered to contact the sheet SH. In this case, after the moisture-absorbing part 21 of the moisture adherer 20 absorbs moisture and the moisture is adhered to the sheet SH, the sensor 32 obtains heat conductivity of the air in the cavity. Further, the moisture adherer 20 is elevated and is separated from the sheet SH.

Further, in the modified example as illustrated in FIG. 8, the moisture adherer 20 including the moisture-absorbing part 21 is employed; however, without being limited to this, the present invention may employ a method of using a pipette to drop liquid droplets.

Additional modifications and variations of the present invention are possible in light of the above teachings. It is therefore to be understood that, within the scope of the appended claims, the invention may be practiced other than as specifically described herein.

What is claimed is:

1. A sheet basis weight sensing device for an image forming apparatus, comprising:

a sheet on which a droplet is deposited;

a sensor to detect heat conductivity of an ambient gas on a surface of the sheet on which the droplet is deposited or the surface opposite the surface of the sheet on which the droplet is deposited before and after the droplet is deposited; and a controller configured to:

measure a time it takes the heat conductivity after the droplet is deposited to change by a predetermined ratio compared to the heat conductivity before deposition of the droplet; and obtain the sheet basis weight based on a relation between the time and the basis weight.

2. The sheet basis weight sensing device as claimed in claim 1, further comprising a memory to store a first table describing a relation between the time and the basis weight.

3. The sheet basis weight sensing device as claimed in claim 2, wherein the memory comprises a second table describing a relation between the detected basis weight and an image forming condition related to the sheet, the sheet basis weight sensing device further comprising an image forming condition controller to set an appropriate image forming condition with reference to the second table.

4. An image forming apparatus comprising a sheet basis weight sensing device as claimed in claim 1.

* * * * *